United States Patent [19]

John et al.

[11] Patent Number: 4,471,704

[45] Date of Patent: Sep. 18, 1984

[54] RECIPROCATING GRATE SYSTEMS FOR FURNACES AND INCINERATORS

[75] Inventors: Floyd C. John; Scott R. Taylor, both of Ogden; Gerald B. Taggart, Eden, all of Utah

[73] Assignee: Clear Air, Inc., Ogden, Utah

[21] Appl. No.: 390,326

[22] Filed: Jun. 21, 1982

[51] Int. Cl.[3] ..... F23H 7/08

[52] U.S. Cl. ..... 110/281; 110/109; 110/114; 110/257; 110/266; 110/286; 110/328

[58] Field of Search ..... 110/101 A, 281, 286, 110/109, 257, 114, 266, 291; 414/156, 209; 198/609, 750, 768, 775

[56] References Cited

U.S. PATENT DOCUMENTS

| | | | |
|---|---|---|---|
| 2,076,739 | 4/1937 | Menough | 198/775 |
| 2,257,488 | 9/1941 | Von Haase | 110/281 |
| 3,451,364 | 6/1969 | Andersen | 110/257 |
| 3,882,803 | 5/1975 | Anderson et al. | 110/109 |
| 4,170,183 | 10/1979 | Cross | 110/257 |
| 4,320,710 | 3/1982 | Steiner et al. | 110/281 |

*Primary Examiner*—Edward G. Favors
*Assistant Examiner*—Steven E. Warner
*Attorney, Agent, or Firm*—M. Ralph Shaffer

[57] ABSTRACT

A new and improved reciprocating grate system for furnaces and incinerators wherein the system is advantageously constructed to accomplish a variety of objectives. Adjacent flights of adjacent portions of the composite grate structure reciprocate back and forth and the speed and stroke of such reciprocation can be ganged, coupled, or independently controlled. The individual grates themselves are advantageously configured for suitable spreading and air mixture relative to debris advancement. Air seals are provided and batch feed is accommodated. Grate frame reciprocation is accommodated by fluid control means, either hydraulic or pneumatic, and features are provided for enabling appropriate adjustment both of drive and stroke of related individual components.

7 Claims, 29 Drawing Figures

RECIPROCATING GRATE SYSTEMS FOR FURNACES AND INCINERATORS

FIELD OF INVENTION

This invention relates to grate systems and, more particularly, to a new and improved reciprocating grate system for furnaces and incinerators.

BRIEF DESCRIPTION OF PRIOR ART

Certain types of incinerators and furnaces employing moveable grate means are now known. Of general pertinence to the present invention are the subject U.S. Pat. Nos.: 3,447,287; 3,451,364; 3,882,803.

These patents are relevant to the present invention in the provision of suitable grating means for certain types of applications relative to furnaces.

Specifically, U.S. Pat. No. 3,882,803 teaches a certain type of reciprocating grate system somewhat related to the present invention but excluding as to the present invention the double rack means for effecting both forward and reverse reciprocation, also the fluid drive and control therefore, and other features.

U.S. Pat. No. 3,451,364 illustrates another type of reciprocating grate structure and in this sense is related somewhat to the present invention. All of these patents are related in general to incinerators, some of which use grates somewhat similar to that contemplated herein; however, there are several unique important advantages and structural differences and changes whereby in the present invention greater facility and greater efficiency of operation can be achieved.

BRIEF DESCRIPTION OF THE PRESENT INVENTION

Accordingly, the subject invention herein comprises a reciprocating grate system for furnaces and incinerators and similar structures, which grating system is fluid regulated, this is to say, hydraulically or pneumatically driven and controlled as by the inclusion of limit switches or other means used to control stroke of reciprocation, for example. The speed of reciprocation in a preferred form of the invention does not rely upon any prime movers such as electric motors or engines, but rather relies upon the speed at which the piston rod of a fluid operated cylinder reciprocates and also the length of stroke of such cylinder. By this feature the disadvantages of electric motors, gasoline engines and the like are avoided. The entire system is pressure driven and operated and suitably controlled for maximum efficiency. The grate plates employed are advantageously configured together with other portions of the structure. Air seals are provided. Registration means are used for effecting proper placement and travel of the individual grate runs. Adjacent flights which are oppositely operated are provided, and suitable means are provided for effecting mutually opposite reciprocation of adjacent flights of the grates used. Adjustment of racks is provided for as necessary.

OBJECTS

Accordingly, a principal object of the present invention is to provide new and improved reciprocating grate structure for furnaces and incinerators.

An additional object is to provide for fluid drive and suitable control of traveling grate structures.

A further object is to provide improved means for oppositely reciprocating adjacent flights of grates relative to a particular grate system.

An additional object is to provide a split grate system that can be employed and incorporated with suitable air seals and/or other means to accommodate appropriate incineration of products introduced into the area provided the grate system.

An additional object is to provide for continuous or batch feeding in an incinerator incorporating the reciprocating grate feature of the invention.

A further object is to provide control means for the grate system utilized wherein speed and/or stroke of reciprocation are regulated.

DESCRIPTION OF DRAWINGS

The present invention may best be understood by reference to the following description, taken in connection with the accompanying drawings in which:

FIG. 1 is a side elevation of certain grate structure, and associated structure, usable in furnace and incinerator constructions and the like.

FIG. 2B is an enlarged, schematically shown transverse cross-section taken along the line 2B—2B in FIG. 1.

FIG. 2 is a top plan, partially broken away, of adjacent flights of a composite grate structure, showing the upper and lower grates of FIG. 1, and illustrating intergrate proximity, and so forth.

FIG. 9 is partially broken away to illustrate the boss and aperture construction of such push plate.

DETAILED DESCRIPTION OF PREFERRED EMBODIMENTS

Figures 1, 2, 2B:
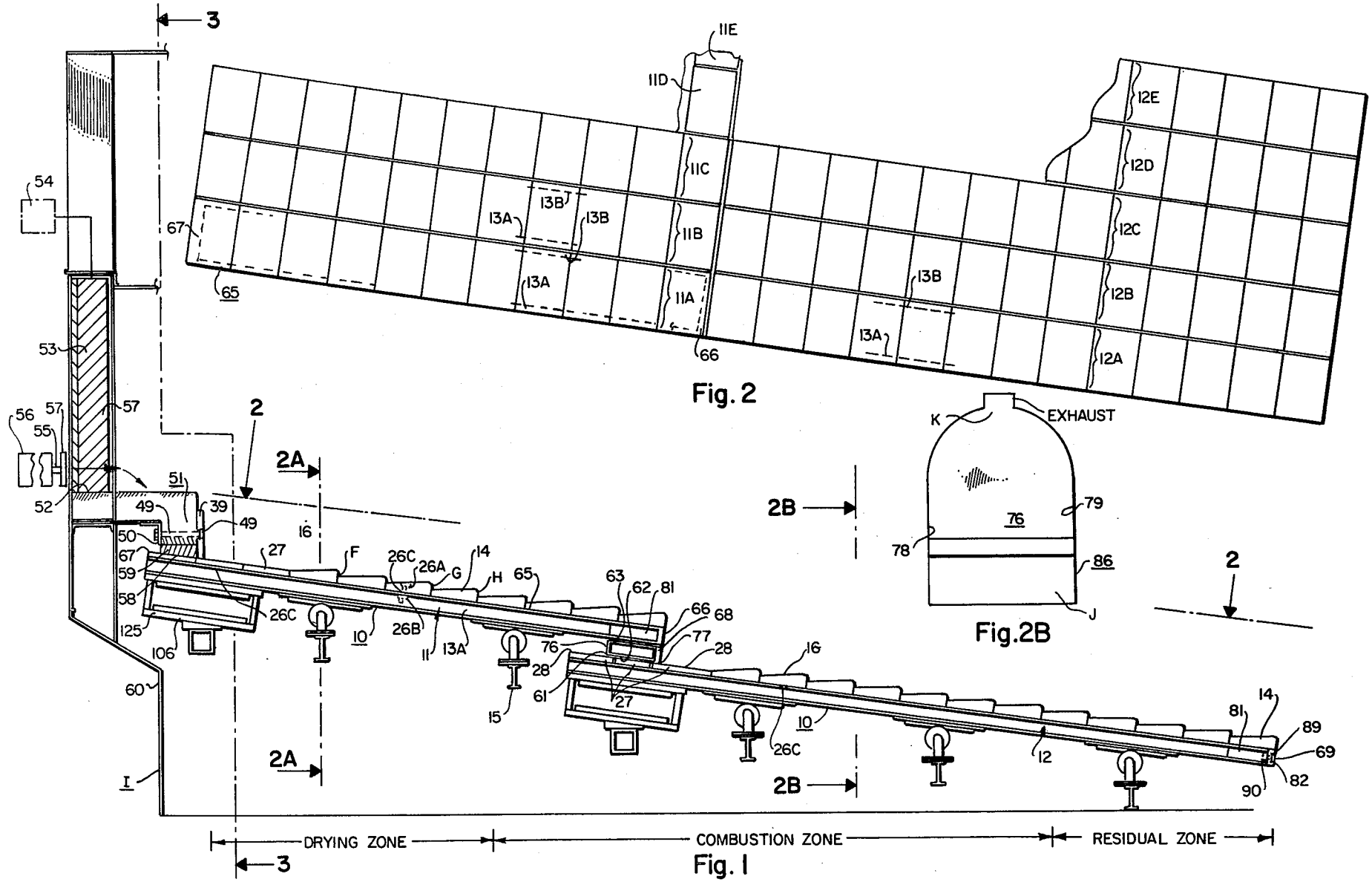
Figure 13:
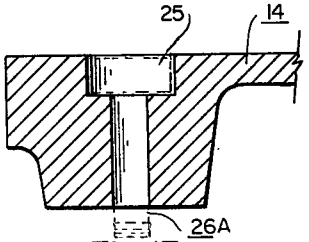
FIG. 13 is an enlarged fragmentary section detail and is a cross-section taken along the line 13—13 in FIG. 11.

In FIGS. 1 and 2 reciprocating grate system 10 shown to include an upper grate 11 and a lower grate 12. Upper grate 11 has a series of side-by-side disposed flights 11A, 11B, 11C, 11D, and 11E. Additional flights may be added side-to-side as needed. Correspondingly, lower grate 12 likewise has a series of flights 12A–12E, see FIG. 2. Similarly, additional flights may be added to the lower grate as needed. Each of the respective flights of each of the upper grate 11 and lower grate 12, respectively, includes opposite-side grate supports 13A, 13B; for each of the respective flights of upper grate 11 and lower grate 12 are a series of principal grate members 14, a representative one of which is detailed in the drawings of FIGS. 10–13, which are secured at opposite side margins to the respective grate supports 13A, 13B by attachments 26A, FIG. 13.

As seen in FIGS. 10–13 each of the principal grate members 14 includes an upper sloped carrying surface 16, a thickened, underneath peripheral margin 17, and edge recesses 18 and 19. Likewise included are enlarged, attachment receiving boss portions 20 and 21, see FIG. 1, for accommodating counterbored apertures 22. The latter include through-apertures 23 and counterbored areas 24 for receiving the heads 25 of attachments 26A, the latter being employed to secure the over-all principal grate member 14 to opposite side channels 13A, 13B. Bolt attachments 26A and nut attachments 26B mutually intercooperate and may be used, with appropriate admitting apertures at 26C being provided at mutually spaced points along the upper flanges, for example, of the opposite grate supports 13A, 13B.

The above method of attachment will be suitable for all of the principal grate members 14 used, for all flights of both upper and lower grates, as well as in connection with the auxiliary grate members 27 employed. Shim washers for nuts 26B can be used.

Returning momentarily to FIGS. 10–12, see especially FIG. 12, it is noted that the upper surface 16 is a carrier surface and slopes rearwardly, see FIG. 1. Also, and because of the edge-to-edge disposition of the principal grate members 14 as seen in FIG. 1, there exist a series of steps, F, G, H, and so on. The purposes for these steps F–H, etc, is to gently spread the incoming material over the upper composite surfaces of the upper and lower grates 11 and 12, and for subsequently gently cascading the material, step-over-step, so that incoming combustion air is mixed with debris or fuel being so advanced.

Figure 6:
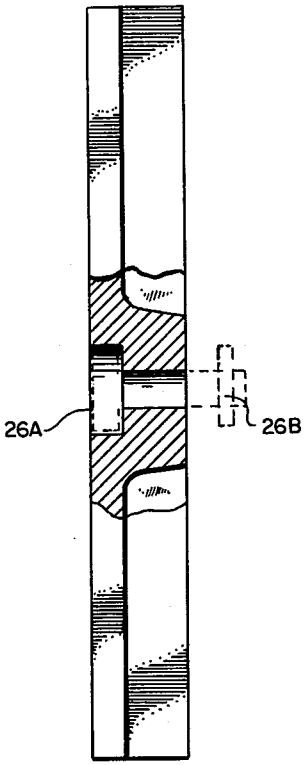
FIGS. 4, 5 and 6 are, respectively, side elevation, top plan, and end elevation, partially broken away, of an auxiliary grate member usable in the construction of FIG. 1.
Figure 5:
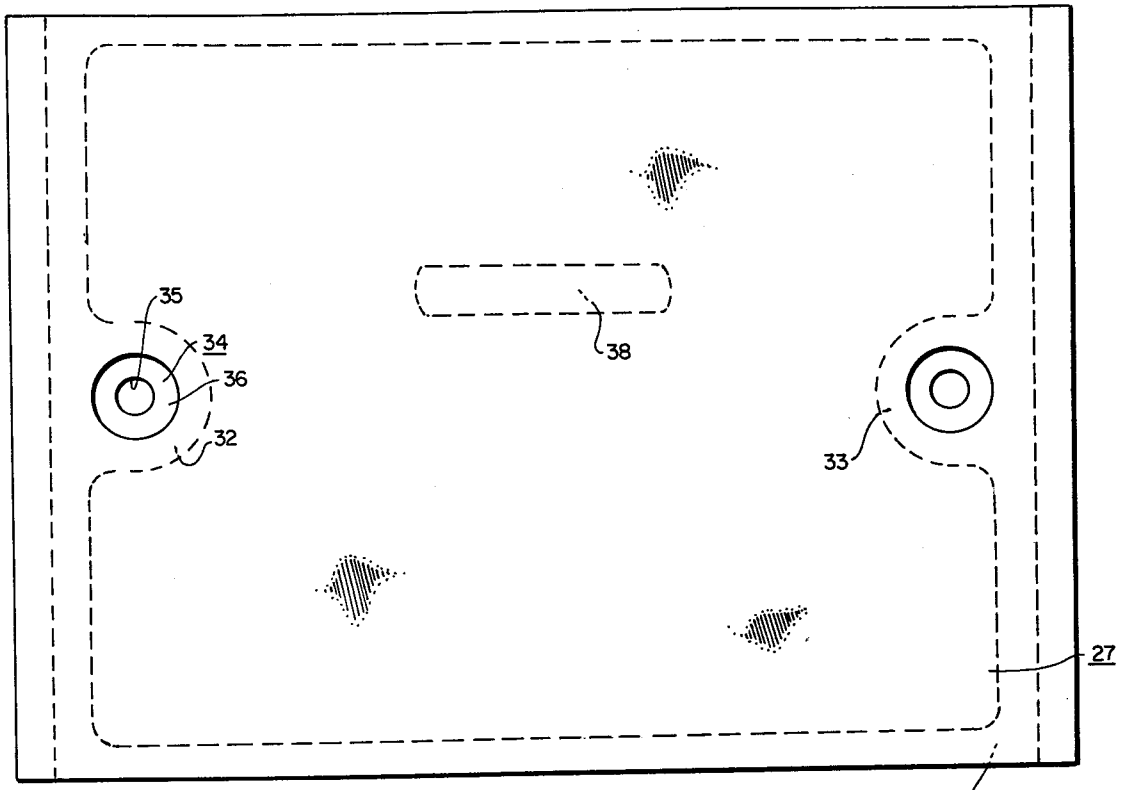
Figure 4:
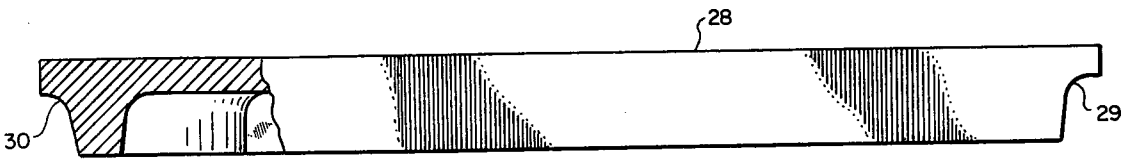

Auxiliary grate member 27 is detailed in FIGS. 4–6. Each of the auxiliary grate members 27 includes an upper carrying surface 28, recessed opposite ends 29 and 30, a thickened, underside, peripheral margin 31, and also thickened bosses 32 and 33 accommodating attachment apertures 34. Similarly here, each of the attachment apertures 34 are constructed to provide a shaft-receiving, elongate through-aperture 35 and, continuous therewith, a bore area 36 for accommodating similar attachments 26A and 26B relative to the attaching of these auxiliary grate members to the opposite side grate supports 13A, 13B. Mutually spaced apertures 26C will likewise be provided in the upper flange of the channel like members 13A, 13B for accommodating such attachments 26A, 26B.

Figure 9:
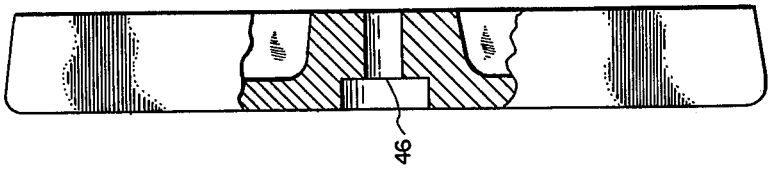
FIGS. 7, 8, and 9 are side elevation, top plan, and end elevation, respectively, of a front push plate usable in the structure of FIG. 1.
Figure 8:
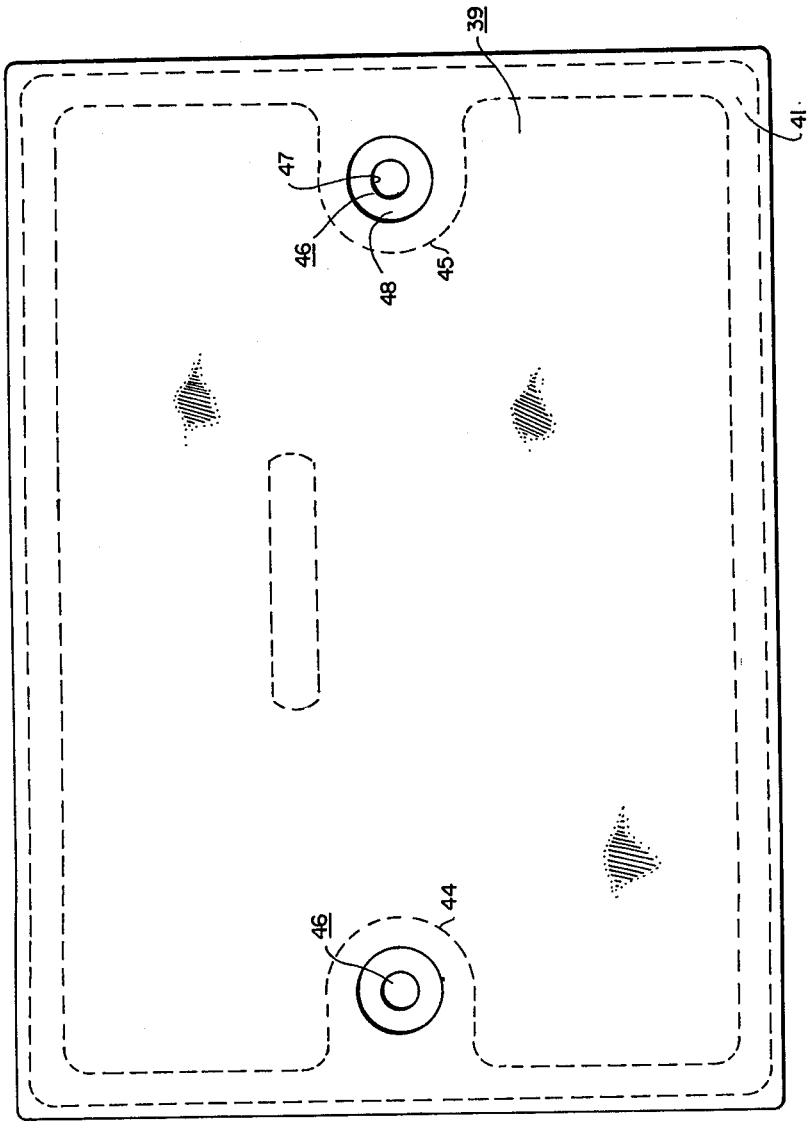
Figure 7:
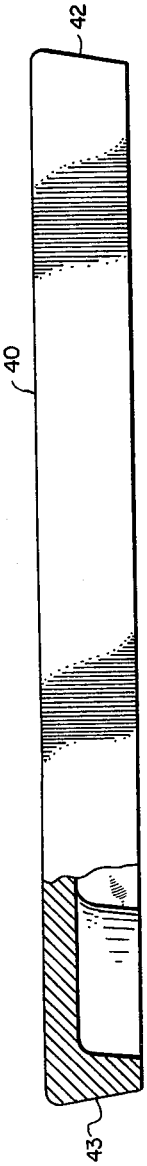
Figure 11:
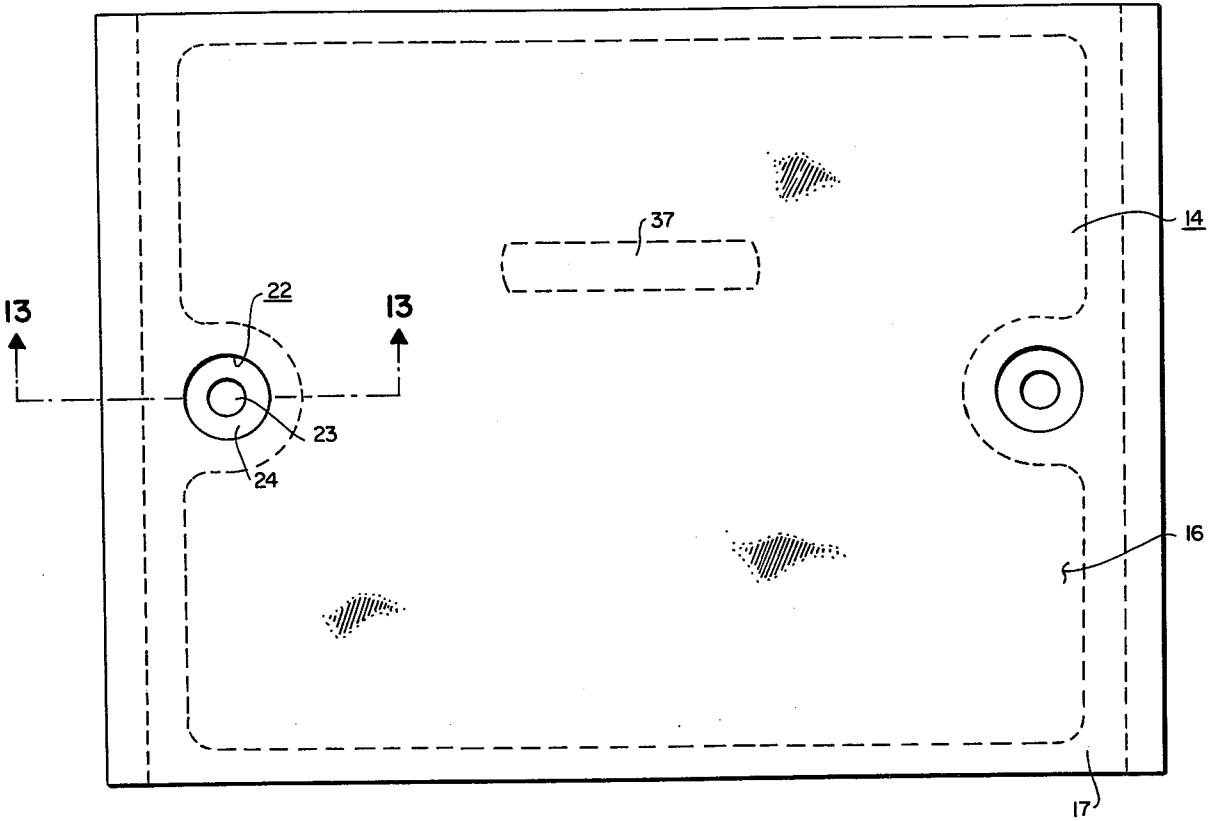
FIGS. 10, 11, and 12 are side elevation (partially broken away), top plan, and end elevation (partially broken away), illustrating the construction of a representative principal grate member.
Figure 10:
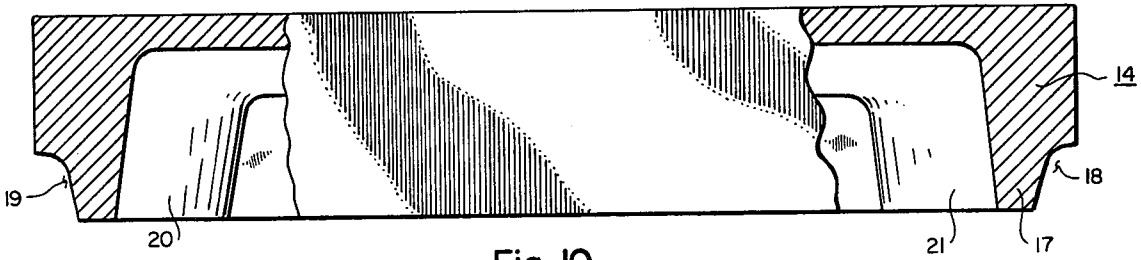
Figure 12:
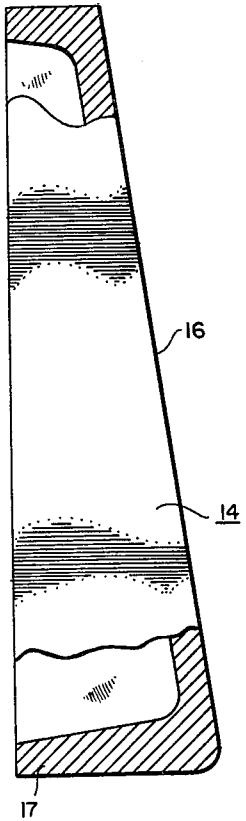

If desired, there may be provided a recessed plate, area, or other suitable means on the underside of each of the grates 14 and 27 for identification purposes. This is shown at dotted line recessed areas 37 and 38, respectively. It should be observed that the principal grate members 14 and the auxiliary grate members 27 will be similarly bolted or otherwise attached in position and disposed as shown in the drawings, see especially FIGS. 1 and 2. It will be noted that the upper surface 28 of representative auxiliary grate member 27 in FIGS. 4–6 is flat and essentially parallel to the descending planes of orientation of the respective opposite-side grate supports 13A, 13B. This is for the purpose of providing an air-seal relative to stationary push-plate 39 which is detailed in FIGS. 7–9. Stationary push-plate 39, shown in FIGS. 7–9, is shown to include a flat vertical surface 40 supported by an underside thickened margin 41, the latter peripherially extending around such member. Likewise, the opposite edges 42 and 43 of such stationary push-plate are recessed as seen in FIG. 7. Thickened underside bosses 44 and 45 accommodate the attachment apertures 46, each of which is composed of a through-aperture 47 and also a recessed bore area 48. All of the recessed bore areas are for the purpose of accommodating the recessing of the heads of attachments so that a smooth surface can be presented and so that such heads will not be burned off during incinerator operation. Accordingly, bolts 49 and nuts 50 may be used in order to mount the stationary push-plate 39 vertically to support structure 51, the latter forming a part of the over-all fixed refractory support for the system. So as to deter, if not prevent, heat damage to the various parts within the interior of the furnace parts such as stationary push-plate 39, auxiliary grate member 27, and principal grate member 14, these and similarly heat-exposed parts are preferably made of a cast steel with a relatively high nickel content. All of this is common in the art as to the selection of the materials suitable for furnace interiors. The illustrated longitudinal cross-section of refractory member 51 as seen in FIG. 1, will extend completely across the front area of the furnace or incinerator in a transverse direction, and the upper surface 52 thereof will serve as a platform across which debris is moved and also a stop for refractory door 53. The refractory door 53 is conventional and is operated up and down by a hydraulic system 54 in a conventional manner. To the left of the door is a push-rod structure 55 taking the form of a hydraulic cylinder 56 and control system, not shown, whereby a movable push-plate 57 attached to the push-rod sequentially pushes and thereby introduces material into the incinerator at times when door 53 is open, thus accommodating batch feed for the incinerator. The material thus proceeds through the opening 57 which is closed by door 53.

In addition to the air seal supplied at 58 between lower surface 59 of refractory structure 51 and the upper surface 28 of the flat grates 27, there is likewise supplied an air seal at 61 as between the underside 62 of bottom structure 63 and the upper surfaces 64 of auxiliary grate members 27.

Figure 16:
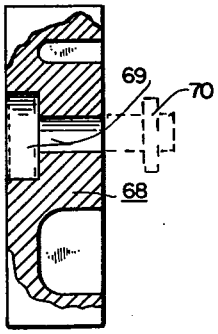
FIGS. 14, 15, and 16 are side elevation (partially broken away), top plan, and end elevation (partially broken away), of a secondary push plate usable in the invention, particularly in the structure of FIG. 1.
Figure 15:
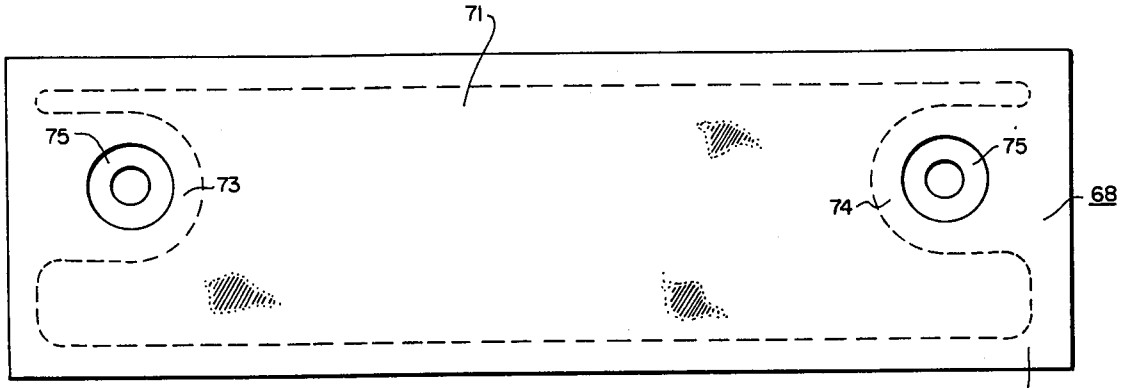
Figure 14:
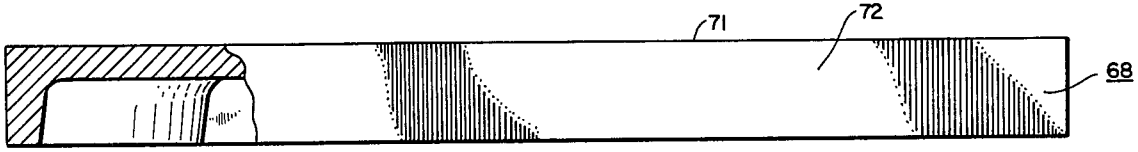

Opposite side grate supports 13A and 13B preferably form part of a frame 65 which includes end channel portions 66 and 67 connecting the opposite-side grates, supports 13A and 13B at their opposite ends, respectively. Disposed underneath and supporting the forward end of the channel frame at 66 is a secondary kicker push-plate 68, shown in FIGS. 14–16, and which is secured in place by a suitable attachments such as bolt attachments 69 and nut attachments 70. Secondary push-plate 68 in FIGS. 14–16 includes an outer surface 71 which is supported by a thickened peripherial margin 72. The latter is provided with thickened boss portions 73 and 74 accommodating counterbored attachment apertures 75. Bolts 69 may be recessed in such attachment apertures 75 and be provided with nuts 70 for securing the respective secondary push-plates, one for each flight of the upper grate 11. It is to be noted that structure 76, which provides the air seals not only at 61 but also at 77, extends transversely across the incinerator interior and is bolted or otherwise secured to the sides 78 and 79 of incinerator 80. It is noted that this structure 76, to which representative secondary push-plate 68 is bolted, is stationary and supplies air seals at both its top and also its bottom surfaces relative to the moving and reciprocating upper and lower grates.

It is desirous to have fixed channel closure plates 81 disposed at opposite sides of each grate support plane for all flights of both the upper grate 11 and the lower grate 12. This is for the purpose of providing an air seal where C-shaped channels are employed relative to grate supports 13A, 13B. It will be observed that the sides of these channels are located proximate to the interior side of the furnaces. Thus, these additional plates 81 will provide an air seal and will be in proximity with the furnace sides and also between each moving flight or platform disposed side by side.

Figure 19:
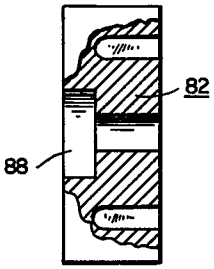
FIGS. 17, 18, and 19 are, respectively, side elevation (partially broken away), top plan, and end elevation (partially broken away) of a frame end plate usable in the invention, and seen in FIG. 1.
Figure 18:
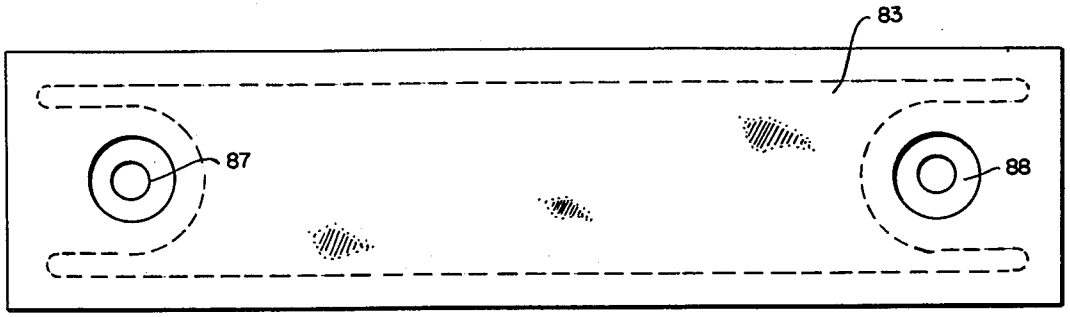
Figure 17:
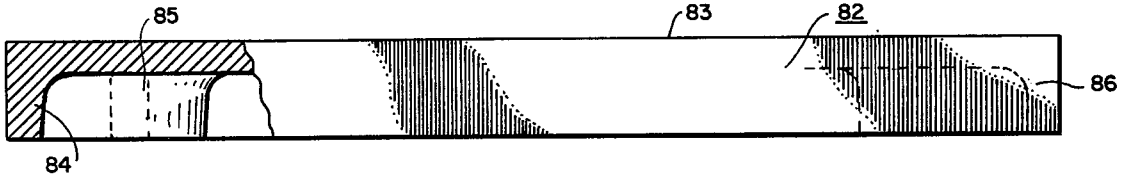

In referring now to the lower right-hand portion of FIG. 1, it is seen that the lowermost principal grate member 14 has its lower transverse side margin disposed over frame end plate 82. This is preferably a cast steel member having a relatively high nickel content so as to be essentially impervious to heat and its effects. Frame end 82 is detailed in FIGS. 17–19 and includes a forward heat-protective surface 83, a peripheral lower side margin 84 lending support to such surface, and enlarged bosses 85 and 86 provided for attachment apertures 87 and 88. These attachment apertures accommodate attachment bolts 89 and nuts 90 which are used to secure the frame end plate 82 to the end of the support frame including lower opposite side grate supports 13A, 13B. This frame end support is simply to serve as a heat barrier relative to the end supporting the respective grate flight.

Figure 22:
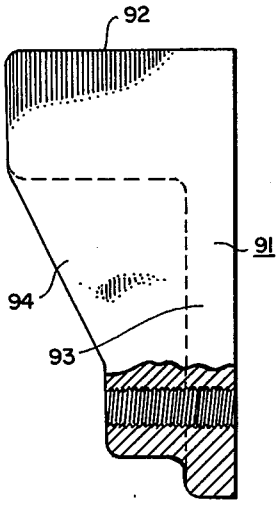
FIGS. 20, 21, and 22, are side elevation, top plan, and end elevation, respectively, of a refractory insert utilized essentially in alignment with grate travel, being disposed proximate thereto on opposite sides thereof as seen in FIG. 3.
Figure 21:
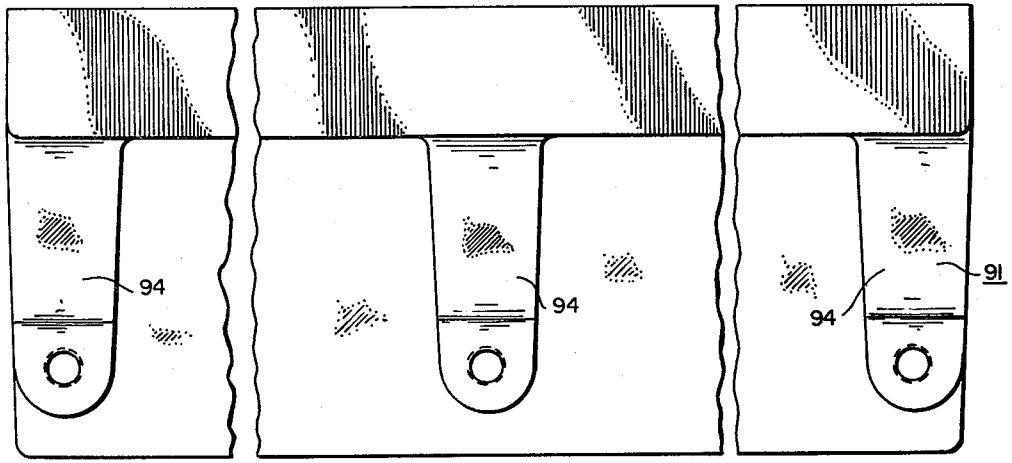
Figure 20:
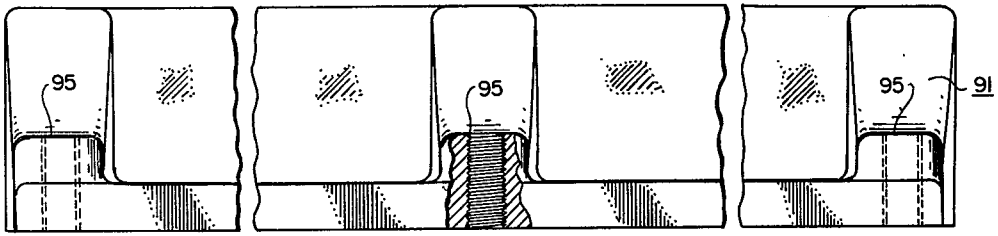

FIGS. 20–22 detail the refractory insert 91, which is reversed, and disposed at opposite sides of the furnace and which is identified at 91 at opposite sides of the grates 11,12. It will be understood that similar inserts are provided for the lower conveyor or lower grate 12. These may be fabricated in four-foot, or other length, sections and simply set into the interior side of the furnace to provide an air seal, see FIG. 3, and permissibly serve as a wearing surface for the outermost edges of the end grate members proximate thereto. As to details, the refractory insert, which may be made again of cast steel having a high nickel content, is seen at 91 in FIGS. 20–22. Refractory insert 91 includes an outer wear surface 92, a base 93, and a series of bosses 94 accommodating attachment apertures 95. These attachment apertures 95 may be employed to receive attachment bolts 96 which pass through apertures 97 of support angle structure 98, see FIG. 3.

Figure 2A:
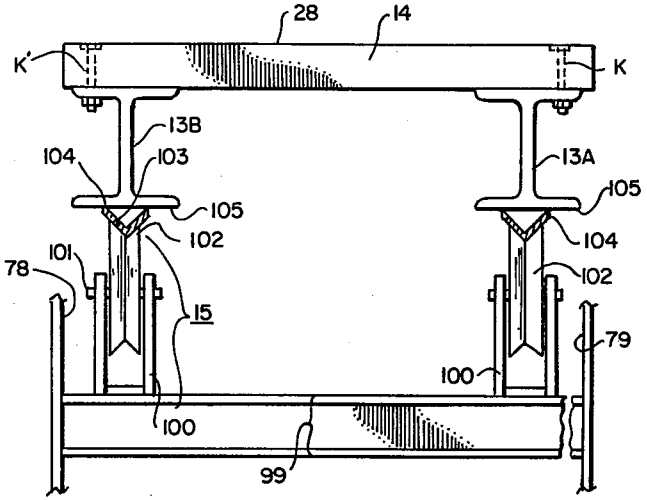
FIG. 2A is an enlarged, transverse, vertical section taken along the line 2A—2A in FIG. 1.

Beams 99, a representative one of which is shown in FIG. 2A, are attached to and extends from opposite sides 78 and 79 of the incinerator and supports thereon a series of castor brackets 100, two of which are shown. These castor brackets are welded or otherwise secured to the several beams 99 and include respective pivot pins or axles 101 which journal respective castors 102. These castors preferably have V-groove exteriors at 103 so as to engage the inverted angle tracks 104 affixed to the lower surfaces 105 of respective opposite side grate supports 13A and 13B. It is noted that the individual grates such as principal grate members 14 are secured in place by nut and bolt attachments at opposite sides, see K and K′ in FIG. 2A, the bolt heads being recessed so as not to extend above the uppermost surface 28 of the respective principal grate members. The same construction will likewise apply relative to those points in the construction at which the auxiliary, flat grate members 27 are connected to the frame. It will be noted, therefore, that each of the flights of the upper and lower grates 11 and 12, will include the frame members 13A and 13B provided with the tracks having transverse V-configured cross-sections whereby the flights of the grates can be aligned in accordance with the positioning of the castors and their mounting brackets. Accordingly, the individual grate flights are free to reciprocate back and forth along their longitudinal axis, are constrained by virtue of the inclusion of the V-groove castors for appropriate longitudinal movement, and are likewise positioned thereby also for appropriate positioning relative to the transverse dimension of the incinerator. All of the flights will be provided with the structure as illustrated in FIG. 2A.

Figure 3B:
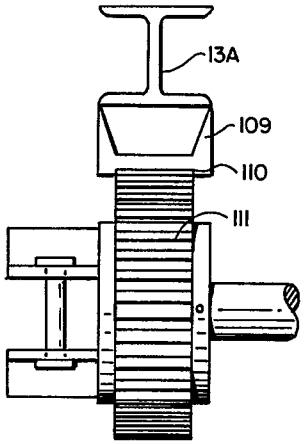
FIG. 3B is an enlarged detail taken along the arcuate line 3B—3B in FIG. 3.
Figure 3:
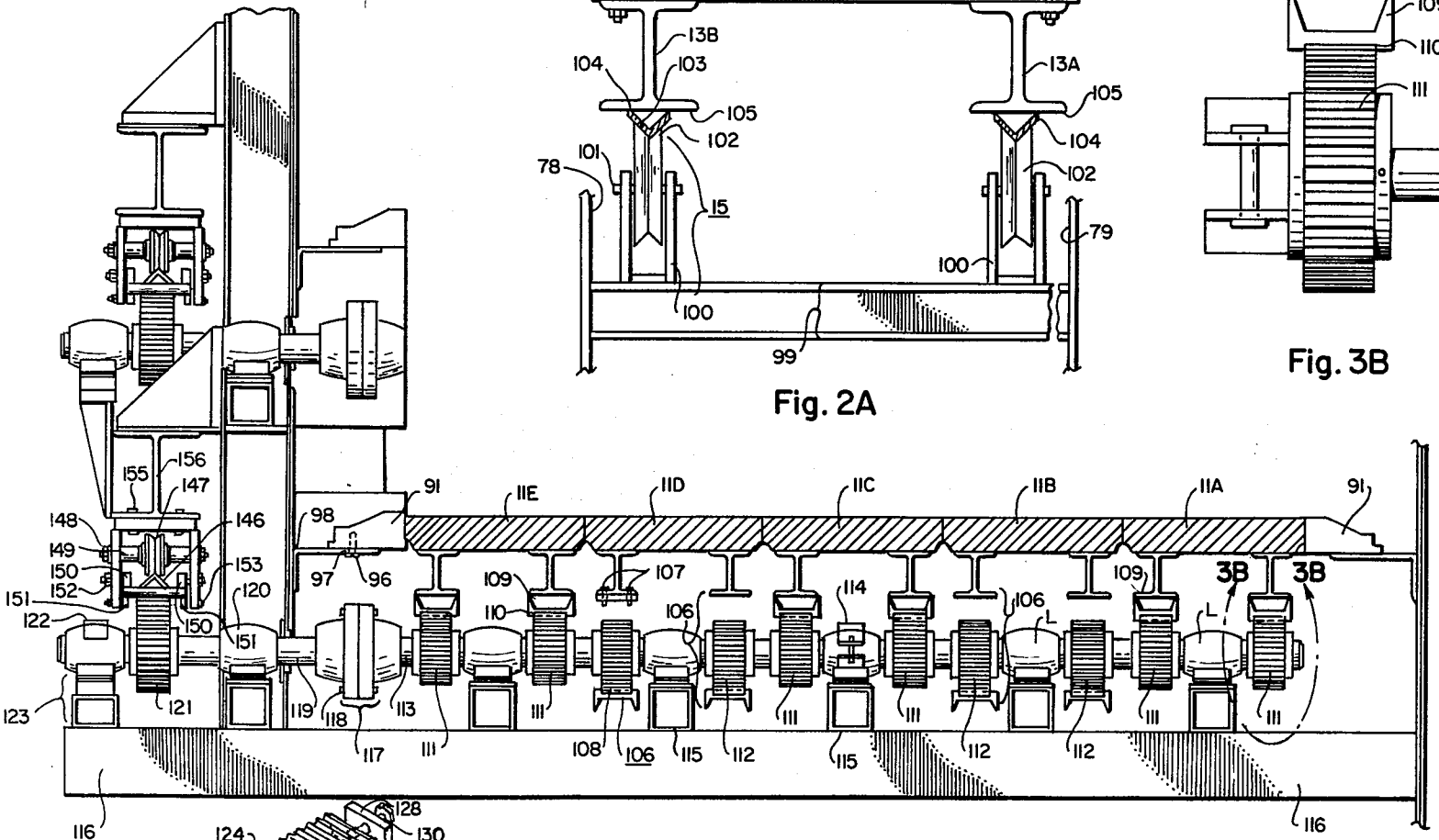
FIG. 3 is an enlarged, transverse, vertical cross-section taken along the line 3—3 in FIG. 1, illustrating a representative drive mechanism for each of the upper and lower grates.

Referring now to FIGS. 1, 3 and 3B it is seen that rack support structure 106 will be provided. The rack support structures 106 are bolted to the undersides of opposite side grate supports 13A and 13B for each of the respective flights both upper and lower grates 12. See attachments 107 in FIG. 3. The apertures accommodating attachments 107 may be made oversized so that slight alignment can be made with these rack support structures so as to accommodate proper tooth engagement with low racks 108 of the respective rack support structures. This will apply to each of the rack support structures 106 shown in FIGS. 1 and 3 as by way of example.

An auxiliary rack support structure 109 has a high rack 110 provided with depending teeth which respectively engage an associated spur gear 111 seen in FIG. 3.

As to the rack support structures 106, their respective, low-placed racks are meshed with the respective pinions 112, see FIG. 3. This construction can be identical for all of the pinions 112. Spur gears 111 and pinions 112 are all mounted upon a common shaft 113 and are keyed or otherwise secured to such shaft for rotation therwith. Pillow-block or other types of bearings at 114 may be split as seen in FIG. 3, and mounted on structures 115 disposed on cross-beam 116, the latter being attached to opposite sides of the incinerator.

Figure 3A:
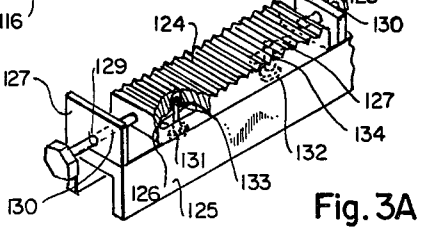
FIG. 3A is a perspective view of a representative support operatively associated at several points in the grating structure, a representative rack gear movably mounted thereto, and means for adjusting the position of such rack gear on such support.

Relative to FIG. 3A, for convenience of discussion, a representative rack 124 is seen and is attached to a representative channel 125 by means of attachment bolts 131 and 132. Elongated apertures 126 and 127 are supplied the respective channels 125 for the upper and also the lower rack gears hereinbefore described, and of which rack gear 124 typifies. The channel 125 is supplied with upwardly extending tabs 127 and 128, the latter including drilled and tapped apertures 129 and 130 for receiving adjustment bolts 130 disposed therein. Accordingly, the turning of the adjustment bolts 130 will adjust the rack gears 124 back and forth in accordance with the desires of the user in aligning the equipment. The slotted apertures at 126 and 127, with the loosening of bolts 131 and 132, will accommodate movement of the rack back and forth. The rack at 124 will be drilled and tapped at 133 and 134 to accommodate attachment bolts 131 and 132. Rack 124 corresponds to racks 108, 110.

The fluid drive system will now be discussed in connection with operating a respective composite grate, i.e. upper grate 11 or lower grate 12. It will be understood that identical but separate structures may be applied and used for the upper grate and the lower grate, respectively, albeit the two may be supplied with the same or parallel-coupled fluid lines relative to a hydraulic pressure source and return. Thus, in FIG. 25, a pair of hydraulic cylinders 135 and 136 will be supplied, cylinder 135 pertaining to the upper grate 11 and cylinder 136 pertaining to the lower grate 12. The cylinders will be provided with conventional and appropriate limit switches for adjusting travel at 137 and 138 in accordance with general practices associated with hydraulic systems in general.

Merely by way of example, cylinder 173, suitably appertured for microswitch feeler arm insertion, may be mounted by means 174 to opposite ends of pressure cylinder 135, with rod 175, having microswitch receiving detents 176 and 177, being provided and being secured at one end by structure 179 to the associated piston rod end. Microswitch 138 will be in fixed position, whereas microswitch 137 will be mounted for selective slidable adjustment to cylinder 173, whereby actuation of microswitch 137 by detent 176, receiving microswitch actuating arm 178, can be adjusted in accordance with the piston stroke, and consequential grate reciprocation stroke, desired. Magnetically actuated microswitches or other conventional sensing-control could also be used. The microswitches shown can be employed to control solenoid valves, not shown, regulating fluid flow reversal in representative pressure cylinder 135.

The pistons 139 and 140 of each of the cylinders will be double-acting and have a single piston rod, see 141, which extends through and beyond the ends of each of the respective cylinders.

For convenience of discussion, the action of solely one cylinder, i.e. cylinder 135, will be discussed in connection with its representative piston rod 141. Piston rod 141 in FIG. 25 has a clevis 142 which attaches by pin means to support guide bar 144. Guide bar 144 mounts the rack 145, as by being welded thereto, and the downwardly facing teeth of the rack 145 engages gear 121 of FIGS. 25 and 3. It is noted that this guide bar 144 also includes, welded thereto, an inverted angle track 146 which itself engages V-type pulley 147. The latter is journalled by nut and bolt attachments 148 and axial pulley structure 149. Cam rollers 150, 151, see also FIG. 3, may be used for supporting and placing the reciprocating support guide bar 144; in fact, these rollers may be cam-type rollers that can be adjusted to insure for correct vertical placement of the bar 144 for proper mesh or rack 145 with gear 121.

It is noted that the entire structure 154 is stationary and is bolted by bolt means 155 to I-beam 156, the latter being bolted or otherwise secured to the side of the incinerator or to fixed structure associated therewith. Limit switches 137 and 138 as above described can be employed, or alternatively, any one of a number of means can be employed to sense piston travel for shutting off and, alternatively, providing for the application of liquid pressure, or even pneumatic pressure, to the particular cylinder involved, i.e. 135, this depending upon the length of the stroke desired relative to rack 145 and ultimately, the several flights of upper grate 11. The speed of reciprocation of the respective piston rods can be controlled by conventional pumping means, not shown, in a manner well known in the art.

Figure 25:
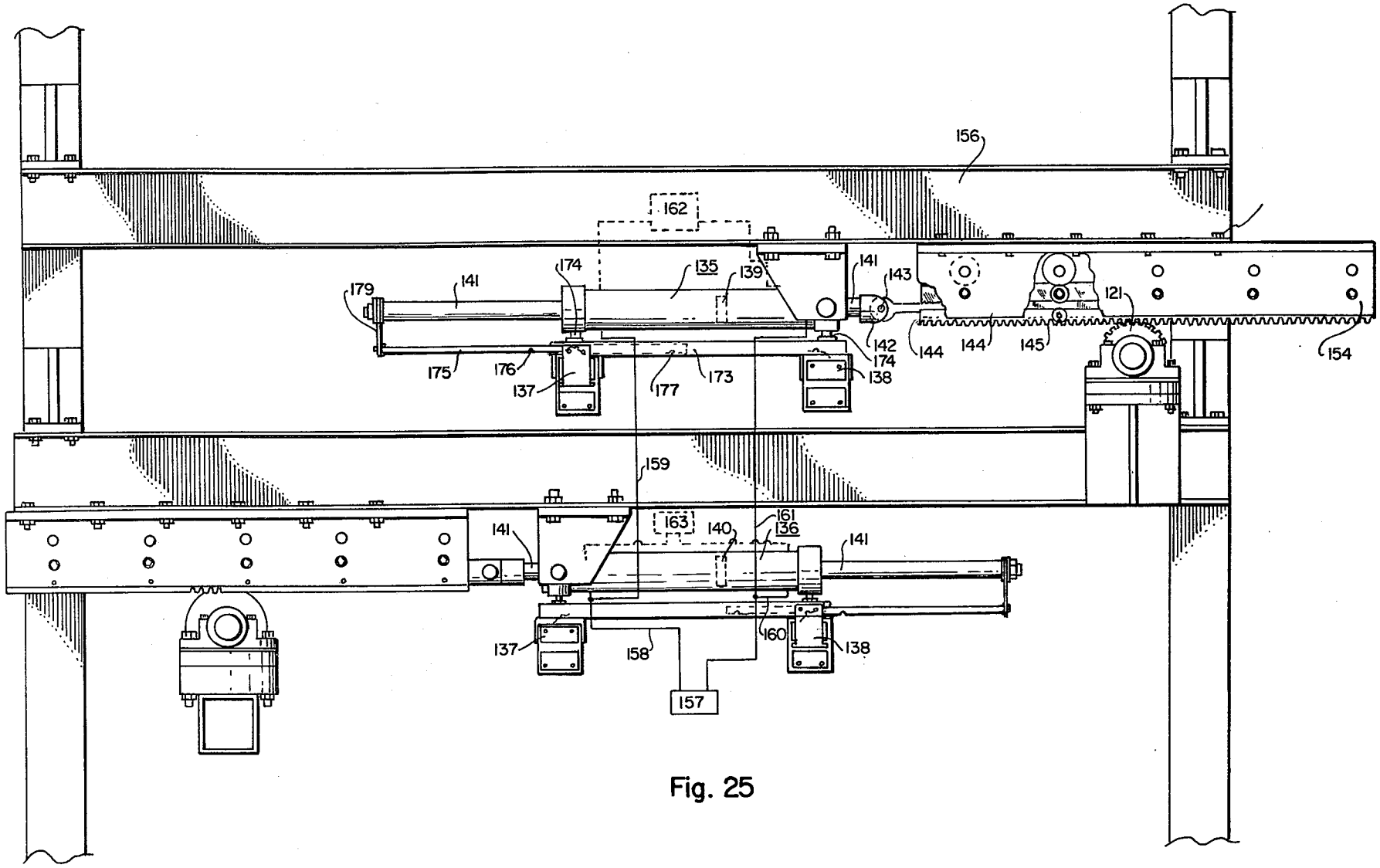
FIG. 25 is a side elevation of the power means utilized to drive and to regulate the stroke of the grating structures of FIG. 1, and is shown somewhat schematically relative to the separate and/or integrated control system therefore.

The lower portion of FIG. 25 is identical in construction to the upper portion, but is concerned with coupling to the lower grate 12 and its corresponding movement. Again, where desired, a hydraulic or pneumatic control may be employed at 157 and coupled by lines 158–161, and so forth, so that both of the pneumatic or hydraulic cylinders can be operated by a single control and supplied by a single hydraulic or pneumatic source.

As an alternative, the upper and lower grates 11 and 12 can be operated separately by the separate hydraulic means 135 and 136 being separately controlled, whereby both of the feed and the stroke of the upper and lower grates can be independently regulated. This is illustrated by the dashed lines 162 and 163 in FIGS. 25, simply indicating separate connections and controls to the respective hydraulic or pneumatic cylinders 135 and 136.

Figure 24:
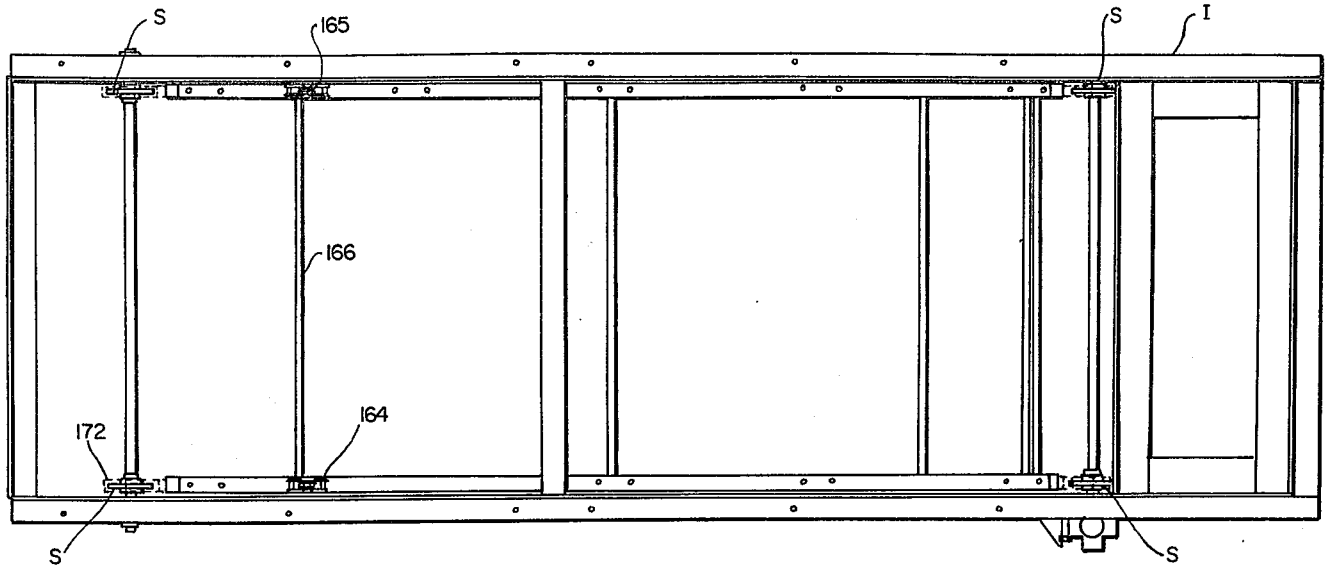
FIGS. 23 and 24 are, respectively, side elevation (partially broken away), and top plan, of the drag means utilized to carry away debris accumulating at the bottom of the incinerator or furnace with which the grate system of the present invention is employed.
Figure 23:
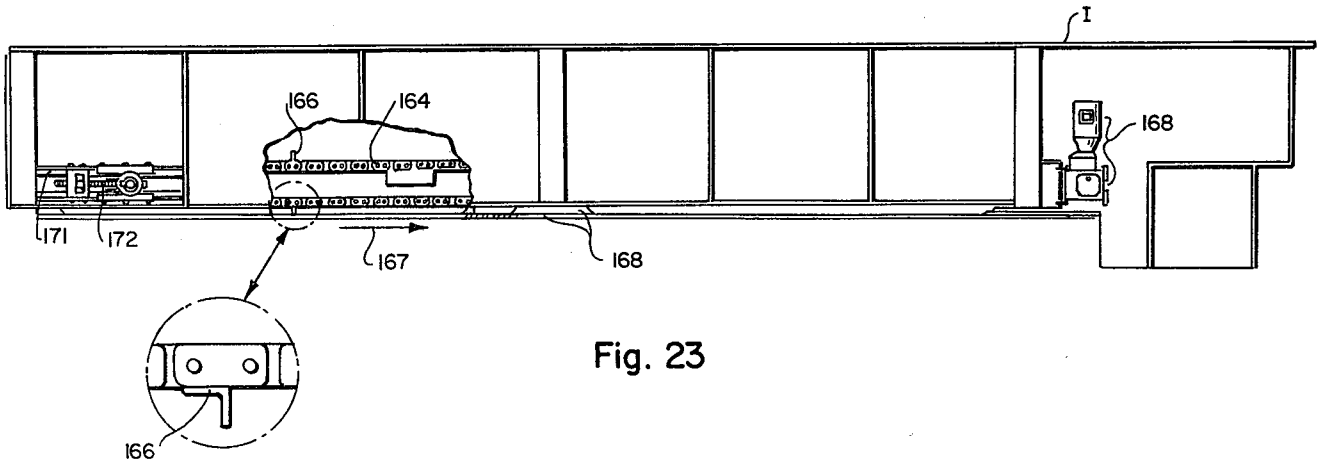

FIGS. 23 and 24 illustrate lowermost structure for disposition within the incinerator I wherein a drag conveyor is employed to convey out of the incinerator any spent materials which may have dropped around or through the grate structures to the incinerator bottom. In this connection, a pair of sprocket chains 164 and 165, of mutually endless configuration, are provided with certain respective, mutually opposite links having inter-link connected transverse angles 166. A plurality of these angles are spaced longitudinally in respective transverse disposition so that these may be employed to advance, in the direction of the arrow 167 in FIG. 23, any materials to be evacuated or removed from the bottom 168 of the furnace. To this end a motor and drive mechanism 169 of any conventional variety may be employed to journal and advance the sprockets in the direction of the arrows 167 and 170, whereby to advance the drag angles 166 in corresponding directions in the manner shown. Structural means at 171 may be provided for retaining the looped end 172 of the sprocket chain and for tightening the same so that appropriate tension can be applied to both flights of the sprocket chain 164. This will apply to both chains disposed at opposite sides of the structure. Accordingly, the drag chain structure of FIGS. 23 and 24 is operative to remove any ash or cinders or other debris which many accumulate at the bottom of the incinerator in a direction to the right to be exhausted finally from such incinerator structure.

In operation, let us assume that the user wishes to operate the upper and lower grates 11 and 12 independently. This being the case, control systems 162 and 163, whatever may be chosen for the same, will be turned on so that the respective cylinders are fully operative and are adjusted, in any suitable manner, for speed of reciprocation and also length of stroke. Thus, the particular reciprocatory travel of the respective upper and lower grates 11 and 12 can be individually controlled and reset. Heat is then supplied by burners (not shown) or other means within the incinerator; the same is raised to temperature until incineration can take place of incoming material. Such incoming materials are pushed to slide over the ramp or platform 52 when door 53 has been opened. This is accomplished by the push-plate 57 in FIG. 1. The incoming materials then are cascaded over structure 51 to enter onto the feed end of the uppermost grate 11. It is noted that the flat grates 27 enjoy an air seal with structure immediately thereabove, see the left side of FIG. 1. Material to be incinerated will proceed downwardly over all flights of the upper grate 11, being advanced of course by the stationary push-plate 39 in conjunction with the respective reciprocatory movements of the several flights making up upper grate 11. Such materials continue to advance downwardly over such grate, cascading over the raised forward ends of the several principal grate members 14 until such debris, in spreading out and mixing with air, reach a point where the same can drop onto the lower grate 12 and its many flights. The breaking up of the composite grate to upper and lower portions 11 and 12 precludes excessively long grates and yet effects the functions desired. Thus, materials cascading over the lowermost principal grate member 14 of each of the several upper flights of the upper grate 11, will drop onto the flat grates 27 of the lower grate 12, so as to be pushed—since these flights here are also reciprocating—along and downwardly to the right over the lower grate 12 and its several flights. Ultimately, the material will advance from left to right over the lower grate until the same drops downwardly over the lower end of the grate, for further disposition and/or transport from the furnace or incinerator.

Again, the reciprocating nature of the upper and lower grates 11 and 12, generally speaking, and the mutually opposite reciprocating nature of adjacent flights for each of the respective grates 11 and 12, accomplish a spreading out, a mixing, and an essentially uniform distribution of debris advancing over such grates so that an essentially even burning can take place.

It will be noted that in general operation, the "drying zone" of incoming materials is located at the space indicated in FIG. 1, and the "combustion zone" is disposed centrally over the composite grate conveyor. Likewise it is seen in the same figure and there will be a "residual zone" for spent materials at the lower right end of the structure, accommodating a final collection of residual gases and a final burning of residual materials thereof. Again, the reciprocatory nature of adjacent flights of opposite directions is accomplished by the structure seen generally in FIG. 3, this so that the unitary rotation of the shaft will produce counter movements of racks, 108, 110 associated with adjacent flights of each respective grate.

Finally, it is likewise to be observed that the straight sides of the incinerator in FIG. 2B accommodate ideally for the reciprocating grate system herein and more especially, when essential air seal structure is used at opposite sides of the grate structure, the lower portion at J can be considered as a plenem for facilitating a regulation of air pressure beneath the grating system to fulfill desired objectives, type of burning, and so on. The straight sides at 78 and 79 are ideal for accommodating the grating structure shown herein and are not used in the prior art as at present advised. The dome structure at the top may be hemi-cylindrical and may be used for the accumulation of gases for exhaust through area K to a different area for further processing.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

We claim:

1. An incinerator including, in combination, a housing having vertical, essentially planar opposite sides, said housing provided with a fixedly and transversely disposed, horizontal cross-beam kicker-plate structure, longitudinally declining reciprocating grate structure disposed in housing, said grate structure comprising upper and lower movable grates overlapping said cross-beam kicker-plate structure above and beneath said structure, respectively, and means for reciprocatingly longitudinally agitating said grate structure, wherein said housing has a refractory interior, said sides having also refractory interiors, and elongate insert means imbedded in said refractory interiors of said sides and disposed closely adjacent and aligned with said grate structure to impede air passage over the sides of said grate structure, and wherein said housing has opposite ends and a bottom in addition to said sides, said sides with said insert means, said grate structure, bottom and ends forming a plenum, and means for controlling the air-pressure within said plenum, said upper and lower grates forming essentially air-seals with said kicker-plate structure above and beneath the latter, respectively.

2. An incinerator construction including within its interior a rearwardly disposed lower grate structure declining front to rear and having a front end, a forwardly disposed upper grate structure and also declining front to rear, plural means for supporting said upper and lower grate structures for individual reciprocal movement, fixed, transversely disposed kicker-plate means disposed between said forwardly disposed upper grate structure and said front end of said lower grate structure, first pressured-fluid-operated cylinder means coupled to said upper grate structure for reciprocating the same, and second pressured-fluid-operated cylinder means coupled to said lower grate structure for reciprocating the latter, and wherein said construction includes means for controlling both speed and stroke of said upper and lower grate structures.

3. An incinerator construction including within its interior a rearwardly disposed lower grate structure declining front to rear and having a front end, a forwardly disposed upper grate structure and also declining front to rear, plural means for supporting said upper and lower grate structures for individual reciprocal movement, fixed, transversely disposed kicker-plate means disposed between said forwardly disposed upper grate structure and said front end of said lower grate structure, first pressured-fluid-operated cylinder means coupled to said upper grate structure for reciprocating the same, and second pressured-fluid-operated cylinder means coupled to said lower grate structure for reciprocating the latter, said incinerator provided with drag line means for advancing spent debris from said incinerator as falls through and on opposite sides of said upper and lower grate structures, said drag line means comprising a pair of mutually opposite sprocket chains, sprocket means supporting said chains at their opposite ends, means for driving said chains coupled thereto, and a plurality of mutually spaced transverse, drag-line elements mutually connected to and across said chains, said incinerator having a bottom proximately disposed beneath said chains.

4. In, an incinerator: a great structure including an elongate frame; a series of grates secured to and across said frame in front-side to rear-side, mutually adjacent configurement; mutually longitudinally spaced, transversely disposed support beams having mutually spaced upwardly extending pulleys having respective peripheral-surface V-grooves, said frame having V-tracks engaging said pulleys at said V-grooves, said grate structure and said incinerator being provided with mutually intercooperating means for reciprocating said elongate frame such that said V-tracks ride in said V-grooves of said pulleys, and wherein said incinerator includes a power-driven, revolvably reciprocating transverse shaft having spur gear means, said frame being provided with upper and lower rack gear means at selected points for engaging upper and lower portions, respectively, of selected ones of said spur gear means.

5. In combination, an incinerator housing having opposite sides; plural horizontal beams extending between and attached to said opposite sides; selected ones of said beams having V-recessed journalled pulleys facing upwardly and provided with peripheral surface V-recesses; a series of grate flights disposed side by side and having V-tracks resting within selected V-recesses of said pulleys; a series of said flights having upwardly facing racks; others of said flights having downwardly facing racks; a revolvably reciprocating shaft supportly journalled to and above a selected one of said beams and having mutually spaced pinion gear means selectively engaging particular ones of said racks, for slideably reciprocating in opposite directions adjacent grate flights; and means for powering said shaft coupled thereto.

6. In an incinerator: first and second, side-by-side juxtaposed fuel support plates; a shaft carrying first and second mutually spaced pinions; means for revolving said shaft sequentially in opposite directions and coupled thereto; a first rack mounted to said first support plate and having depending teeth engaging said first pinion at an upper surface thereof; and a second rack mounted to and depending from said second support plate and having upstanding teeth engaging said second pinion at a lower surface thereof, whereby like rotational displacements of said pinions, through revolvement of said shaft in a selected direction produces opposite translations of said first and second racks and, consequently, said first and second support plates.

7. An incinerator including, in combination: a housing; declining burner grate structure disposed in said housing; means for moving said grate structure coupled thereto; and drag line means for advancing spent debris from said incinerator as falls through and on opposite sides of said grate structure, said drag line means comprising a pair of mutually opposite sprocket chains, sprocket means supporting said chains at their opposite ends, means for driving said chains coupled thereto, and a plurality of mutually spaced transverse, drag-line elements mutually connected to and across said chains, said incinerator having bottom proximately disposed beneath said chains.

* * * * *